US005354605A

United States Patent [19]

Lin et al.

[11] Patent Number: 5,354,605

[45] Date of Patent: Oct. 11, 1994

[54] SOFT ARMOR COMPOSITE

[75] Inventors: Leroy C.-T. Lin; Laura G. Wilson; David V. Cunningham, all of Chesterfield, Va.

[73] Assignee: AlliedSignal Inc., Morris Township, Morris County, N.J.

[21] Appl. No.: 42,175

[22] Filed: Apr. 2, 1993

[51] Int. Cl.[5] ..... B32B 7/00

[52] U.S. Cl. ..... 428/263; 428/260; 428/253; 428/289; 428/290; 428/492; 428/911; 428/280; 428/105; 428/114; 428/224; 428/284; 428/285; 428/347; 428/348; 428/902

[58] Field of Search ..... 428/224, 105, 114, 228, 428/258, 260, 263, 284, 285, 289, 290, 347, 348, 902, 911

[56] References Cited

U.S. PATENT DOCUMENTS

| | | | |
|---|---|---|---|
| 3,912,682 | 10/1975 | Tucker | 428/911 |
| 3,925,293 | 12/1975 | Knechtges et al. | 428/911 |
| 4,357,442 | 11/1982 | Shah | 428/911 |
| 4,619,960 | 10/1986 | Dodge | 428/911 |
| 4,623,574 | 11/1986 | Harpell et al. | 428/911 |
| 4,650,710 | 3/1987 | Harpell et al. | 428/911 |
| 4,820,568 | 4/1989 | Harpell et al. | 428/911 |
| 5,167,876 | 12/1992 | Lem et al. | 252/602 |
| 5,175,040 | 12/1992 | Harpell et al. | 428/911 |

FOREIGN PATENT DOCUMENTS 0525418 2/1993 European Pat. Off. .

OTHER PUBLICATIONS

"Hycar Acrylic Latexes" by B. F. Goodrich, Publication No. L17, May 17, 1985.

*Primary Examiner*—Patrick J. Ryan
*Assistant Examiner*—R. Weisberger
*Attorney, Agent, or Firm*—Wayne W. Rupert

[57] ABSTRACT

An article which includes at least one layer of a network of high strength fibers, preferably extended chain polyethylene fibers. The fibers of the network are coated with a very low modulus elastomeric matrix material, preferably an acrylic ester copolymer, which has a tensile modulus of less than about 100 psi, a tenacity of less than 450 psi (3105 kPa), a glass transition temperature ($T_g$) of about −10° C. to about −20° C., and an elongation-to-break of at least about 2000%. The article can further include a second matrix material, preferably made of polyethylene, adjacent to the fiber network layer.

20 Claims, 1 Drawing Sheet

SOFT ARMOR COMPOSITE

BACKGROUND OF THE INVENTION

The present invention relates to a flexible ballistic resistant composite article which includes a network of high strength fibers coated or impregnated with an elastomeric matrix material.

Various constructions are known for ballistic resistant articles such as vests, curtains, mats, raincoats and umbrellas. These articles display varying degrees of resistance to penetration by high speed impact from projectiles such as BB's, bullets, shells, shrapnel, glass fragments and the like. U.S. Pat. Nos. 4,820,568; 4,748,064; 4,737,402; 4,737,401; 4,681,792; 4,650,710; 4,623,574; 4,613,535; 4,584,347; 4,563,392; 4,543,286; 4,501,856; 4,457,985; and U.S. Pat. No. 4,403,012 describe ballistic resistant articles which include high strength fibers made from materials such as extended chain ultra-high molecular weight polyethylene. Typically these fibers are coated, embedded or impregnated with a resin matrix. Of particular interest among the above disclosures is the description of the materials that can be used for the resin matrix that is found, for example, at column 6, line 44 to column 7, line 11, of U.S. Pat. No. 4,820,568; column 5, lines 40–56 of U.S. Pat. No. 4,623,574; and column 4, lines 40–59 of U.S. Pat. No. 4,650,710. In addition to these patents, commonly assigned copending U.S. Pat. No. 5,175,040 describes a flexible multi-layered impact resistant article wherein the flexibility is a result of the manner in which the successive layers are adhered to each other.

Although the ballistic resistant articles described in the above documents provide sufficient protection against most threats, a need exists for further improvement in ballistic resistance and improved flexibility for the articles.

SUMMARY OF THE INVENTION

It is therefore an object of the present invention to provide an article, preferably a composite article, with improved ballistic performance and flexibility.

In accomplishing the foregoing objects there is provided according to the present invention an article which includes at least one layer of a network of high strength fibers, preferably extended chain polyethylene fibers. The fibers of the network are coated with a very low modulus elastomeric matrix material, preferably an acrylic ester copolymer, which has a tensile modulus of less than about 100 psi (690 kPa), a tenacity of less than 450 psi (3105 kPa), a glass transition temperature ($T_g$) of about −10° C. to about −20° C., and an elongation-to-break of at least about 2000%. The article can further include a thin film, preferably made of polyethylene, adjacent to the coated fiber network layer.

The matrix material used in the invention substantially improves the flexibility of the composite and, thus, increases the comfort level for an individual wearing soft armor comprised of the composite. Surprisingly, as described below in more detail, the matrix material also improves the ballistic resistance of the composite.

Further objects, features and advantages of the present invention will become apparent from the detailed description of preferred embodiments that follows.

BRIEF DESCRIPTION OF THE DRAWING

The invention will be described in more detail below with reference to the drawing, wherein.

DETAILED DESCRIPTION OF THE INVENTION

Figure 1:
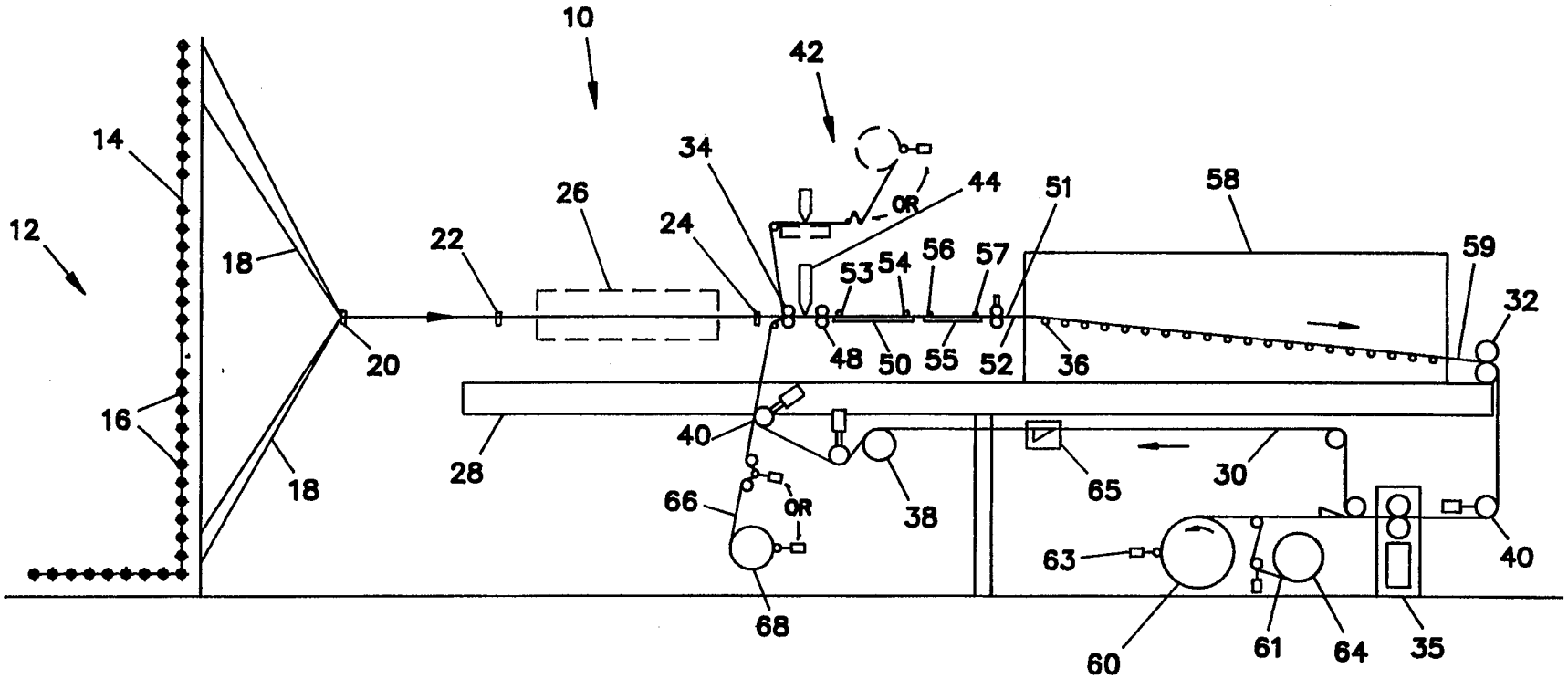
FIG. 1 is a schematic diagram of an apparatus for producing the article of the invention.

The present invention provides an improved, flexible article which is particularly useful as ballistic resistant "soft" armor. By "soft" armor is meant an article, such as a bulletproof vest, which is sufficiently flexible to wear as a protective garment.

As used herein, "fiber network" denotes a plurality of fibers arranged into a predetermined configuration or a plurality of fibers grouped together to form a twisted or untwisted yarn, which yarns are arranged into a predetermined configuration. The fiber network can have various configurations. For example, the fibers or yarn may be formed as a felt, knitted or woven into a network, or formed into a network by any conventional techniques. According to a particularly preferred network configuration, the fibers are unidirectionally aligned so that they are substantially parallel to each other along the longitudinal direction of the network layer.

As used herein, "fiber" denotes an elongate body, the length dimension of which is much greater than the transverse dimensions of width and thickness. Accordingly, "fiber" includes monofilament, multi-filament, ribbon, strip, staple and other forms of chopped, cut or discontinuous fiber and the like having regular or irregular cross-sections. "Fiber" includes a plurality of any one of the above or a combination of the above.

The cross-sections of filaments for use in this invention may vary widely. They may be circular, flat or oblong in cross-section. They also may be of irregular or regular multi-lobal cross-section having one or more regular or irregular lobes projecting from the linear or longitudinal axis of the filament. It is particularly preferred that the filaments be of substantially circular, flat or oblong cross-section, most preferably the former.

High strength fibers for use in this invention are those having a tenacity equal to or greater than about 7 g/d, a tensile modulus equal to or greater than about 150 g/d and an energy-to-break equal to or greater than about 8 Joules/gram (J/g). Preferred fibers are those having a tenacity equal to or greater than about 10 g/d, a tensile modulus equal to or greater than about 200 g/d and an energy-to-break equal to or greater than about 20 J/g. Particularly preferred fibers are those having a tenacity equal to or greater than about 16 g/d, a tensile modulus equal to or greater than about 400 g/d, and an energy-to-break equal to or greater than about 27 J/g. Amongst these particularly preferred embodiments, most preferred are those embodiments in which the tenacity of the fibers is equal to or greater than about 22 g/d, the tensile modulus is equal to or greater than about 900 g/d, and the energy-to-break is equal to or greater than about 27 J/g. In the practice of this invention, fibers of choice have a tenacity equal to or greater than about 28 g/d, the tensile modulus is equal to or greater than about 1200 g/d and the energy-to-break is equal to or greater than about 40 J/g.

Illustrative of useful organic filaments are those composed of polyesters, polyolefins, polyetheramides, fluoropolymers, polyethers, celluloses, phenolics, polyesteramides, polyurethanes, epoxies, aminoplastics, silicones, polysulfones, polyetherketones, polyetheretherketones, polyesterimides, polyphenylene sulfides, polyether acryl ketones, poly(amideimides), and polyimides. Illustrative of other useful organic filaments are those composed of aramids (aromatic polyamides); aliphatic and cycloaliphatic polyamides; and aliphatic, cycloaliphatic, and aromatic polyesters; and the like, such as are disclosed in U.S. Pat. No. 4,916,000, hereby incorporated by reference.

Also illustrative of useful organic filaments are those of liquid crystalline polymers such as lyotropic liquid crystalline polymers which include polypeptides such as poly-benzyl L-glutamate and the like; aromatic polyamides such as poly(1,4-benzamide), poly(chloro-1-4-phenylene terephthalamide), poly(1,4-phenylene fumaramide), poly(chloro-1,4-phenylene fumaramide), poly(4,4'-benzanilide trans, trans-muconamide), poly(1,4-phenylene mesaconamide), poly(1,4-phenylene) (trans-1,4-cyclohexylene amide), poly(chloro-1,4-phenylene) (trans-1,4-cyclohexylene amide), poly(1,4-phenylene 1,4-dimethyl-trans-1,4-cyclohexylene amide), poly(1,4-phenylene 1,4-dimethyl-trans-1,4cyclohexylene amide), poly (1,4-phenylene 2.5-pyridine amide), poly(chloro-1,4-phenylene 2.5-pyridine amide), poly(3,3'-dimethyl-4,4'-biphenylene 2.5 pyridine amide), poly(1,4-phenylene 4,4'-stilbene amide), poly(chloro-1,4-phenylene 4,4'-stilbene amide), poly(1,4-phenylene 4,4'-azobenzene amide), poly(4,4'-azobenzene 4,4'-azobenzene amide), poly(1,4-phenylene 4,4'-azoxybenzene amide), poly(4,4'-azobenzene 4,4'-azoxybenzene amide), poly(1,4-cyclohexylene 4,4'-azobenzene amide), poly(4,4'-azobenzene terephthal amide), poly(3,8-phenanthridinone terephthal amide), poly(4,4'-biphenylene terephthal amide), poly(4,4'-biphenylene 4,4'-bibenzo amide), poly(1,4-phenylene 4,4'-bibenzo amide), poly(1,4-phenylene 4,4'-terephenylene amide), poly(1,4-phenylene 2,6-naphthal amide), poly(1,5-amide), poly(1,4-phenylene 2,6-naphthal amide), poly(1,5-naphthalene terephthal amide), poly(3,3'-dimethyl-4,4-biphenylene terephthal amide), poly(3,3'-dimethoxy-4,4'biphenylene terephthal amide), poly(3,3'-dimethoxy-4,4-biphenylene 4,4'-bibenzo amide) and the like; polyoxamides such as those derived from 2,2'-dimethyl-4,4'-diamino biphenyl and chloro-1,4-phenylene diamine; polyhydrazides such as poly chloroterephthalic hydrazide, 2,5-pyridine dicarboxylic acid hydrazide) poly(terephthalic hydrazide), poly(terephthalic-chloroterephthalic hydrazide) and the like; poly(amidehydrazides) such as poly(terephthaloyl 1,4 aminobenzhydrazide) and those fprepared from 4-aminobenzhydrazide, oxalic dihydrazide, terephthalic dihydrazide and para-aromatic diacid chlorides; polyesters such as those of the compositions include poly(oxy-trans-1,4-cyclohexyleneoxycarbonyl-trans-1,4-cyclohexylenecarbonyl-b-oxy-1,4-phenyl-eneoxyteraphthaloyl) and poly(oxy-cis-1,4-cyclohexyleneoxycarbonyl-trans-1,4-cyclohexylenecarbony 1b-oxy-1,4-phenyleneoxyterephthaloyl) in methylene chloride-o-cresol poly(oxy-trans-1,4-cyclohexylene oxycarbonyl-trans-1,4-cyclohexylenecarbonyl-b-oxy-(2-methyl-1,4-phenylene)oxy-terephthaloyl) in 1,1,2,2-tetrachloroethane-o-chlorophenol-phenol (60:25:15 vol/vol/vol), poly[oxy-trans-1,4-cyclohexyleneoxycarbonyl-trans-1,4-cyclohexylenecarbony 1b-oxy(2-methyl-1,3-phenylene)oxy-terephthaloyl] in o-chlorophenol and the like; polyazomethines such as those prepared from 4,4'-diaminobenzanilide and terephthalaldephide, methyl-1,4-phenylenediamine and terephthalaldehyde and the like; polyisocyanides such as poly(α-phenyl ethyl isocyanide), poly(n-octyl isocyanide) and the like; polyisocyanates such as poly(n-alkyl isocyanates) as for example poly(n-butyl isocyanate), poly(n-hexyl isocyanate) and the like; lyotropic crystalline polymers with heterocyclic units such as poly(1,4-phenylene-2,6-benzobisthiazole) (PBT), poly(1,4phenylene-2,6-benzobisoxazole) (PBO), poly(1,4-phenylenel,3,4-oxadiazole), poly(1,4-phenylene-2,6benzobisimidazole), poly[2,5(6)-benzimidazole](AB-PBI), poly[2,6-(1,4-phenylene-4-phenylquinoline)]poly[1,1'-(4,4'-biphenylene)-6,6'-bis(4-phenylquinoline)] and th like; polyorganophosphazines such as polyphosphazine, polybisphenoxyphosphazine, poly[bis(2,2,2'trifluoroethylene) phosphazine] and the like; metal polymers such as those derived by condensation of transbis(tri-n-butylphosphine)platinum dichloride with a bisacetylene or transbis(tri-n-butylphosphine)bis(1,4-butadinynyl)platinum and similar combinations in the presence of cuprous iodine and an amide; cellulose and cellulose derivatives such as esters of cellulose as for example triacetate cellulose, acetate cellulose, acetatebutyrate cellulose, nitrate cellulose, and sulfate cellulose, ethers of cellulose as for example, ethyl ether cellulose, hydroxymethyl ether cellulose, hydroxypropyl ether cellulose, carboxymethyl ether cellulose, ethyl hydroxyethyl ether cellulose, cyanoethylethyl ether cellulose, ether-esters of cellulose as for example acetoxyethyl ether cellulose and benzoyloxypropyl ether cellulose, and urethane cellulose as for example phenyl urethane cellulose; thermotropic liquid crystalline polymers such as celluloses and their derivatives as for example hydroxypropyl cellulose ethyl cellulose propionoxypropyl cellulose; thermotropic copolyesters as for example copolymers of 6-hydroxy-2-naphthoic acid and p-hydroxy benzoic acid, copolymers of 6-hydroxy-2-naphthoic acid, terephthalic acid and p-amino phenol, copolymers of 6-hydroxy-2-naphthoic acid, terephthalic acid and hydroquinone, copolymers of 6hydroxy-2-naphthoic acid, p-hydroxy benzoic acid, hydroquinone and terephthalic acid, copolymers of 2,6-naphthalene dicarboxylic acid, terephthalic acid, isophthalic acid and hydroquinone, copolymers of 2,6-naphthalene dicarboxylic acid and terephthalic acid, copolymers of p-hydroxybenzoic acid, terephthalic acid and 4,4'-dihydroxydiphenyl, copolymers of p-hydroxybenzoic acid, terephthalic acid, isophthalic acid and 4,4'-dihydroxydiphenyl, p-hydroxybenzoic acid, isophthalic acid, hydroquinone and 4,4'-dihydroxybenzophenone, copolymers of phenylterephthalic acid and hydroquinone, copolymers of chlorohydroquinone, terephthalic acid and p-acetoxy cinnamic acid, copolymers of chlorohydroquinone, terephthalic acid and ethylene dioxy-4,4'-dibenzoic acid, copolymers of hydroquinone, methylhydroquinone, p-hydroxybenzoic acid and isophthalic acid, copolymers of (1-phenylethyl)hydroquinone, terephthalic acid and hydroquinone, and copolymers of poly(ethylene terephthalate) and p-hydroxybenzoic acid; and thermotropic polyamides and thermotropic copoly(amide-esters).

Also illustrative of useful organic filaments are those composed of extended chain polymers formed by polymerization of α,β-unsaturated monomers of the formula:

$$R_1R_2{-}C{=}CH_2$$

wherein:

$R_1$ and $R_2$ are the same or different and are hydrogen, hydroxy, halogen, alkylcarbonyl, carboxy, alkoxycarbonyl, heterocycle or alkyl or aryl either unsubstituted or substituted with one or more substituents selected from the group consisting of alkoxy, cyano, hydroxy, alkyl and aryl. For greater detail of such polymers of $\alpha,\beta$-unsaturated monomers, see U.S. Pat. No. 4,916,000, previously incorporated by reference.

Illustrative of useful inorganic filaments for use in the present invention are glass fibers such as fibers formed from quartz, magnesia alumuninosilicate, non-alkaline aluminoborosilicate, soda borosilicate, soda silicate, soda lime-aluminosilicate, lead silicate, nonalkaline lead boroalumina, non-alkaline barium boroalumina, non-alkaline zinc boroalumina, non-alkaline iron aluminosilicate, cadmium borate, alumina fibers which include "saffil" fiber in eta, delta, and theta phase form, asbestos, boron, silicone carbide, graphite and carbon such as those derived from the carbonization of polyethylene, polyvinyl alcohol, saran, aramid, polyamide (Nomex type), polybenzimidazole, polyoxadiazole, polyphenylene, PPR, petroleum and coal pitches (isotropic), mesophase pitch, cellulose and polyacrylonitrile, ceramic fibers, metal fibers as for example steel, aluminum metal alloys, and the like.

In the preferred embodiments of the invention, the networks are fabricated from high molecular weight extended chain polyethylene filament, high molecular weight extended chain polypropylene filament, aramid filament, high molecular weight polyvinyl alcohol filament, high molecular weight polyacrylonitrile filament, liquid crystalline polymer filament, carbon filament, or mixtures thereof.

U.S. Pat. No. 4,457,985, hereby incorporated by reference, generally discusses such high molecular weight extended chain polyethylene and polypropylene filaments. In the case of polyethylene, suitable filaments are those of molecular weight of at least 150,000, preferably at least 300,000, more preferably at least one million and most preferably between two million and five million. Such extended chain polyethylene (ECPE) filaments may be grown in solution as described in U.S. Pat. No. 4,137,394 or U.S. Pat. No. 4,356,138, or may be a filament spun from a solution to form a gel structure, as described in German Off. 3 004 699 and GB 20512667, and especially described in U.S. Pat. No. 4,551,296, also hereby incorporated by reference. Commonly assigned copending U.S. patent application Ser. No. 803,860 (filed Dec. 9, 1991) and U.S. patent application Ser. No. 803,883 (filed Dec. 9, 1991), both hereby incorporated by reference, describe alternative processes for removing the spinning solvents from solution or gel spun fibers such as the ones described previously.

According to the system described in U.S. patient application Ser. No. 803,860, the spinning solvent-containing fiber (i.e., the gel or coagulate fiber) is contacted with an extraction solvent which is a non-solvent for the polymer of the fiber, but which is a solvent for the spinning solvent at a first temperature and which is a non-solvent for the spinning solvent at a second temperature. More specifically, the extraction step is carried out at a first temperature, preferably 55° to 100° C., at which the spinning solvent is soluble in the extraction solvent. After the spinning solvent has been extracted, the extracted fiber is dried if the extraction solvent is sufficiently volatile. If not, the fiber is extracted with a washing solvent, preferably water, which is more volatile than the extraction solvent. The resultant waste solution of extraction solvent and spinning solvent at the first temperature is heated or cooled to where the solvents are immiscible to form a heterogeneous, two phase liquid system, which is then separated.

According to the system described in U.S. patent application Ser. No. 803,883, the gel or coagulate fiber is contacted with an extraction solvent which is a non-solvent for the polymer of the fiber, but which is a solvent for the spinning solvent. After the spinning solvent has been extracted, the extracted fiber is dried if the extraction solvent is sufficiently volatile. If not, the fiber is extracted with a washing solvent, preferably water, which is more volatile than the extraction solvent. To recover the extraction solvent and the spinning solvent, the resultant waste solution of extraction solvent and spinning solvent is treated with a second extraction solvent to separate the solution into a first portion which predominantly comprises the first spinning solvent and a second portion which contains at least about 5% of the first extraction solvent in the waste solution.

The previously described highest values for tenacity, tensile modulus and energy-to-break are generally obtainable only by employing these solution grown or gel filament processes. A particularly preferred high strength fiber is extended chain polyethylene fiber known as Spectra® which is commercially available from Allied-Signal, Inc. As used herein, the term polyethylene shall mean a predominantly linear polyethylene material that may contain minor amounts of chain branching or comonomers not exceeding 5 modifying units per 100 main chain carbon atoms, and that may also contain admixed therewith not more than about 50 weight percent of one or more polymeric additives such as alkene-1-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as antioxidants, lubricants, ultraviolet screening agents, colorants and the like which are commonly incorporated by reference.

Similarly, highly oriented polypropylene of molecular weight at least 200,000, preferably at least one million and more preferably at least two million, may be used. Such high molecular weight polypropylene may be formed into reasonably well-oriented filaments by techniques described in the various references referred to above, and especially by the technique of U.S. Pat. Nos. 4,663,101 and 4,784,820. and U.S. patent application Ser. No. 069 684, filed Jul. 6, 1987 (see published application WO 89 00213). Since polypropylene is a much less crystalline material than polyethylene and contains pendant methyl groups, tenacity values achievable with polypropylene are generally substantially lower than the corresponding values for polyethylene. Accordingly, a suitable tenacity is at least about 10 g/d, preferably at least about 12 g/d, and more preferably at least about 15 g/d. The tensile modulus for polypropylene is at least about 200 g/d preferably at least about 250 g/d, and more preferably at least about 300 g/d. The energy-to-break of the polypropylene is at least about 8 J/g, preferably at least about 40 J/g, and most preferably at least about 60 J/g.

High molecular weight polyvinyl alcohol filaments having high tensile modulus are described in U.S. Pat.

No. 4,440,711, hereby incorporated by reference. Preferred polyvinyl alcohol filaments will have a tenacity of at least about 10 g/d, a modulus of at least about 200 g/d and an energy-to-break of at least about 8 J/g, and particularly preferred polyvinyl alcohol filaments will have a tenacity of at least about 15 g/d, a modulus of at least about 300 g/d and an energy-to-break of at least about 25 J/g. Most preferred polyvinyl alcohol filaments will have a tenacity of at least about 20 g/d, a modulus of at least about 500 g/d and an energy-to-break of at least about 30 J/g. Suitable polyvinyl alcohol filament having a weight average molecular weight of at least about 200,000 can be produced, for example, by the process disclosed in U.S. Pat. No. 4,599,267.

In the case of polyacrylonitrile (PAN), PAN filament for use in the present invention are of molecular weight of at least about 400,000. Particularly useful PAN filament should have a tenacity of at least about 10 g/d and an energy-to-break of at least about 8 J/g. PAN filament having a molecular weight of at least about 400,000, a tenacity of at least about 15 to about 20 g/d and an energy-to-break of at least about 25 to about 30 J/g is most useful in producing ballistic resistant articles. Such filaments are disclosed, for example, in U.S. Pat. No. 4,535,027.

In the case of aramid filaments, suitable aramid filaments formed principally from aromatic polyamide are described in U.S. Pat. No. 3,671,542, which is hereby incorporated by reference. The aramid filament will have a tenacity of at least about 15 g/d, a modulus of at least about 400 g/d and an energy-to-break of at least about 8 J/g. Preferred aramid filament will have a tenacity of at least about 20 g/d, a tensile modulus of at least about 500 g/d and an energy-to-break at least about 20 J/g, and particularly preferred aramid filaments will have a tenacity of at least about 20 g/d, a modulus of at least about 1000 g/d and an energy-to-break of at least about 20 J/g. Most preferred aramid filaments will have a tenacity of at least about 22 g/d, a modulus of at least about 900 g/d and an energy-to-break of at least about 27 J/g. For example, poly(p-phenylene terephthalamide) filaments produced commercially by Dupont Corporation under the trade name of Kevlar® 29, 49, 129 and 149 and having moderately high moduli and tenacity values are particularly useful in forming ballistic resistant composites. Also useful in the practice of this invention is poly(metaphenylene isophthalamide) filaments produced commercially by Dupont under the trade name Nomex.

In the case of liquid crystal copolyesters, suitable filaments are disclosed, for example, in U.S. Pat. Nos. 3,975,487; 4,118,372; and 4,161,470, hereby incorporated by reference. Tenacities of about 15 to 30 g/d, more preferably about 20 to 25 g/d, modulus of about 500 to 1500 g/d, preferably about 1000 to 1200 g/d, and an energy-to-break of at least about 10 J/g are particularly desirable.

The high strength fibers are coated with a very low modulus, elastomeric matrix material which has a tensile modulus of less than about 100 psi (690 kPa), preferably less than about 50 psi (345 kPa), most preferably about 35 psi (241 kPa) or less, a tenacity of less than about 450 psi (3105 kPa), preferably less than 400 psi (2760 kPa), most preferably less than about 350 psi (2415 kPa), a $T_g$ (as evidenced by a sudden drop in the ductility and elasticity of the material) of about −10° C. to about −20° C., preferably about −15° C., and an elongation-to-break of at least about 2000%, preferably about 2150%, and most preferably about 2300%. Preferably, the high strength fibers are substantially coated by the very low modulus elastomeric matrix material. The fibers, however, may be only partially coated with the very low modulus elastomeric matrix material or may be completely encapsulated by the very low modulus elastomeric matrix material.

Although any elastomeric material meeting the property criteria set forth above can be used in the invention, a particularly useful material is acrylic ester copolymer. Especially preferred is a group of anionic emulsions of acrylic ester copolymers in water available from B. F. Goodrich under the trade name Hycar®, particularly Hycar 26083 (hereinafter referred to as "acrylic latex resin"). This acrylic latex resin is preferred because it can consisently satisfy the strict property requirements of the invention. For example, Hycar 26083 has a tensile modulus of 35 psi (241 kPa), a $T_g$ of −15° C., and an elongation-to-break of 2400% and Hycar 2671 has a tensile modulus of 67 psi (462 kPa), a tenacity of 259 psi (1787 kPa), a $T_g$ of −11° C., and an elongation-to-break of 2035%. Another advantage of this acrylic latex resin is that it requires a water solvent instead of an organic solvent. Accordingly, the manufacturing of the article of the invention does not need to take into account the evaporation of potentially harmful organic solvents when the fiber networks are being dried after having been coated with the acrylic latex resin.

A simple composite can be formed from the very low modulus elastomer-coated high strength fiber networks. "Simple composite" is intended to denote an article that includes at least one layer of fibers combined with a single major matrix material, in this instance, the very low modulus elastomer, whether or not there are other materials such as fillers, lubricants or the like. Simple composite materials may be constructed and arranged in a variety of forms. It is convenient to characterize the geometries of such composites by the geometries of the fibers. One such suitable arrangement is a plurality of layers in which the coated fibers are aligned parallel to one another along a common fiber direction (referred to herein as a "unidirectionally aligned fiber network"). Successive layers of such coated, unidirectional fibers can be rotated with respect to the previous layer.

The very low modulus elastomer-coated fiber network also can be used to form more complex composites. For example, the composite can include the very low modulus elastomer-coated fiber network and a second matrix material. In a preferred embodiment the second matrix material is in the form of a film which is adjacent to at least one side of a coated fiber network. The coated fiber network can be pressed or embedded into the second matrix material so that the second matrix material at least partially encompasses the coated fibers.

Among second matrix material films which can be used in the invention are thermoplastic polyolefins, thermoplastic elastomers, crosslinked thermoplastics, crosslinked elastomers (e.g., ethylene propylene diene and butyl rubber), polyester, polyamide, fluorocarbon, urethane, epoxy, polyvinylidene chloride, and polyvinyl chloride. Homopolymers or copolymers of these films can be used as well as blends, and the films preferably are uniaxially or biaxially oriented.

Another elastomer useful as the second matrix material are block copolymers of conjugated dienes and vinyl aromatic monomers. Butadiene and isoprene are preferred conjugated diene elastomers. Styrene, vinyl toluene and t-butyl styrene are preferred conjugated aromatic monomers. The copolymers may be simple tri-block copolymers of the type A-B-A, multiblock copolymers of the type $(AB)_n$ (n=2–10) or radial configuration copolymers; wherein A is a block from a polyvinyl aromatic monomer and B is a block from a conjugated diene elastomer. Many of these copolymers are produced commercially by the Shell Chemical Co. under the trade name Kraton ® and are described in its bulletin "Kraton Thermoplastic Rubber" SC-68-81.

It is especially preferred that the film be made of high density polyethylene (preferably having a melting point of about 105° C.), polypropylene, or a blend of polyethylene and Kraton (available from Raven Industries). Such a film acts as an oxygen barrier, provides surface modification and allows for the separation of individual layers after they have been manufactured but prior to molding of the final article.

In the preferred case of high density polyethylene film, a film thickness of about 4 to 80 μ, preferably 15 to 25 μ, is used and a pressure of about 0.001 to 1.5 kg/mm$^2$, more preferably 0.01 to 0.15 kg/mm$^2$ and a temperature, preferably of about 60 to 400°, more preferably 100° to 160°, are employed for pressing the coated fiber network into the film.

The article or composite of the present invention can be produced by a variety of methods. For example, the fiber or yarn can be transported through a solution of the very low modulus elastomeric matrix material to substantially coat the fiber or yarn and then dried to form a coated fiber or yarn. The resulting coated fiber or yarn can be arranged into the desired network configuration to form a layer of ballistic material. Alternatively, the fiber network can be constructed initially and then coated with the very low modulus matrix material.

A preferred method for making the article employs a separate film (the second matrix material) upon which the fiber or yarn is disposed and then coated. More specifically, the high strength fibers are transported through a comb means which collimates the fibers to form a unidirectionally aligned fiber network. The unidirectional fibers are laid onto a moving film of the second matrix material. A solution of the very low modulus elastomeric matrix material then is coated onto the fibers which are laying on the film, thereby adhering the fibers to the film. The very low modulus elastomeric material may penetrate between the fibers and the film and should occupy substantially all the void space between the fibers, although some void spaces may remain. The matrix material is subsequently dried. In the preferred case of acrylic latex resin as the very low modulus elastomeric material, the drying temperature is about 220°–240° C., preferably about 225°–235° C., more preferably about230° C. The coating and drying steps can be repeated to achieve the desired amounts of matrix material relative to the amount of fiber.

An apparatus useful for carrying out this method is described in commonly assigned U.S. Pat. No. 5,149,391, hereby incorporated by reference. The film of the second matrix material is supported on a conveyor belt through a matrix material coating station and an oven. The fibers, film and conveyor belt are advanced by pull rolls, one of which contacts the fibers and the other of which contacts the conveyor belt. The apparatus also includes at least one pressure actuated press roll which consolidates the fiber, matrix material and film.

A preferred embodiment of the apparatus described in U.S. Pat. No. 5,149,391 is illustrated in FIG. 1. The apparatus is generally shown as reference character 10. The components necessary to control and support the apparatus can be supported by a suitable frame such as frame 28. Other portions can be supported on the ground or floor. There is a fiber supply 12. The fiber supply 12 is a creel 14 having a plurality of spools 16. Fiber 18 is fed from the fiber supply 12 to a means to form the fiber into a unidirectional web or network. In the embodiment in FIG. 1, the means to form the fiber into a network is a series of combs. There is at least one coarse comb 20 to align the fibers in a common plane. Downstream fine combs 22 can have comb teeth spaced closer together until a desired number of fiber ends per inch is achieved and the fibers are unidirectionally spaced relative to one another. There can optionally be drying of the fibrous network by a drying means 26 between fine comb 22 and fine comb 24. The combs and drying means are kept in relative position by a frame 28. The dryer 26 can be a heated dryer, heated by infrared radiation, or hot air heated, the latter being preferred. The dryer 26 is used to eliminate or reduce moisture in the fiber, and/or preheat the fiber before the fibrous network enters the coating station.

The unidirectional fibrous network is then coated with the matrix composition. Preferably, the fibrous network is first fed onto a bottom film 66 which is feed from film supply roll 68 and is supported on the surface of endless conveyor belt 30. Conveyor belt 30 vertically supports the fibrous network and/or film 66. The conveyor belt continuously circulates through a continuous path. Idler and tension controls are provided as necessary. The conveyor belt circulates in the direction the fibrous network travels in a path away from the combs. The fibrous network is supported on the conveyor belt and pulled along with the conveyor belt by suitable pull means such as at least one set of pull rolls 32. In the embodiment illustrated in FIG. 1, the fibrous network is first supported by the conveyor belt 30 immediately ahead of positioning roll 34. The fibrous network is conveyed through the various coating and treating stations supported on conveyor belt 30.

The apparatus preferably has a back up or second set of pull rolls 35. The conveyor belt can have suitable support or idler rolls 36, tension control rolls 38 and steering rolls 40. The fibrous network is thereby supported and conveyed by conveyor belt 30.

The fibrous network is preferably coated with the very low modulus elastomeric matrix composition while supported on the conveyor belt 30. A useful coating station 42 is illustrated in FIG. 1. Preferably the coater is a transverse coater 44. There is a set of positioning rolls 34 and a set of gauge rolls 48 downstream from the transverse coater 44. The positioning rolls 34 hold the fibers in position while transverse coater 44 deposit the very low modulus elastomeric matrix composition along the total transverse direction of the fibrous network. Gauge rolls 48 are provided to maintain a controlled thickness of the coated network. A useful transverse coater is the "Uhing" linear drive made by Amicoil, Inc. of Aston Pa.

The coated network advances from the coating station 42 to a heater means. A preferred heater is platen heater 50. The conveyor belt 30 has an outside surface 51 on which the fibrous network is supported, and an inside surface 52 on which the conveyor belt 30 is supported. The platen heater is located close to and preferably in contact with the conveyor belt inside surface 52. While the specific dimensions can be varied depending on the materials used and the product to be made, a useful platen is 36 inches long (in the axial direction) and can heat a coated network traveling at a speed of up to 50 feet per minute and typically 30 feet per minute from room temperature up to 120° C., and typically to 100° C. The platen heater is used to heat the supported network through the conveyor belt by conduction to apply a uniform heat to the network.

There can be a first means to compact the fibrous network, film and very low modulus elastomeric matrix composition associated with the heater means. The compacting means can be at least one set of compression rollers. In the embodiment illustrated in FIG. 1 there are two compaction rollers, although only one is necessary and more than two can be used. First heating compaction roll 53 and second heating compaction roll 54 assert pressure as the coated fibrous network and the conveyor belt pass between the compaction rolls and the platen 50. The pressure causes the very low modulus elastomeric matrix composition to consolidate with the fibrous network and the fibrous network to press into the film. The compaction rolls also control the thickness of the coated network.

The supported network can then be conveyed to an optional cooling means which is preferably a chilled platen 55. The chilled platen is preferably in contact with the inside surface 52 of the conveyor belt for uniform cooling. While the specific dimensions can be varied depending on the materials used and the product to be made, a useful chilled platen is 24 inches (in the axial direction) and can cool a network traveling at up to 50 feet per minute and typically 30 feet per minute from 120° C. to room temperature.

There can be second compacting means to compact the fibrous network and matrix composition after the cooling station. The compacting means can be at least one set of compression rollers. In the embodiment illustrated in FIG. 1 there are two compaction rollers, although only one is necessary and more than two can be used. First cooling compaction roll 56 and second cooling compaction roll 57 assert pressure as the coated fibrous network and the conveyor belt pass between the compaction rolls and the cooling platen 55. The pressure causes the matrix composition to consolidate with the fibrous network. The compaction rolls also control the thickness of the impregnated network.

The coated network advances from the coater to oven 58. The oven is provided to heat the coated network. Preferably the oven is a convection-type oven which uses a heated gas such as air to heat the coated network. Heating in this manner is applied to drive off volatile components of the coating composition and to cause any chemical reaction which may be desirable. Other type ovens such as conducting and radiation ovens can be used.

Upon exiting the oven at oven exit 59 and passing through pull rolls 32, the prepreg is made ready to be collected for storage. The prepreg can be cut to flat sheets or rolled up and stored as desired. In the embodiment shown in FIG. 1 the prepreg is rolled on a suitable means such as product rewinder roll 60. The tension between the pull rolls 32 and rewinder roll 60 can be less than the tension between the creel 14 and pull rolls 32. The tension can be only that which is sufficient to wind up the prepreg. A liner 61 can be used as desired when the prepreg is wound on product wind roll 60. The liner 61 is used to prevent the prepreg from sticking to itself in storage and to protect the structure of the prepreg during rolling. Using low tension is desirable to facilitate removal of the prepreg from the liner 61. The product rewind roll 60 is shown with an appropriate tension control 63. The liner is supplied from a liner roll 64.

In instances where the very low modulus elastomeric matrix material is supplied in the form of a film, U.S. Pat. No. 5,173,138, hereby incorporated by reference, describes a method for making the resin impregnated fibrous network of the present invention. This method includes feeding a matrix film onto at least one side of the fiber network, pressing the film of resin matrix into the fiber network while heating for a time sufficient to impregnate the fiber network with the film without damaging the fibers and physical properties of the resin matrix.

In preferred embodiments of the invention, a plurality of the undirectionally aligned fiber network layers are placed (laid up) into a stack to form a multi-layer composite. A film of the second matrix material can be included with each coated fiber network layer (thus the number of individual films would equal the number of layers) or it can be applied to at least one outside surface of the multi-layer composite of coated fiber networks. The individual simple composite layers can be prepregs which, when stacked and subjected to molding, form the multi-layer composite. The very low modulus elastomeric matrix material resin can act as adhesive to bond the individual layers or a separate adhesive can be used to bond the individual layers.

Preferably the fiber network layers are cross-plied, that is, with the undirectional fibers of each layer rotated with respect to the undirectional fibers of the adjacent layers. An example is a five layer article with the second, third, fourth and fifth layers rotated +45°, −45°, 90° and 0° with respect to the first layer. A preferred example includes two layers with a 0°/90° layup. Commonly assigned copending U.S. patent application Ser. No. 564,214 (filed Aug. 8, 1990), hereby incorporated by reference, describes an apparatus and method for making such a cross-plied continuous length of material.

The proportion of matrix material to fiber in an individual layer or multi-layer composite may vary widely, depending upon the end use. If the density of the matrix material is similar to that of the fiber, then the very low modulus elastomeric matrix material may generally form from about 10 to about 40% by weight, preferably about 14 to 30%, more preferably 16 to 24%, and most preferably about 18 to 22%, based on the weight of an individual layer or the final composite. For ballistic resistant composite articles, the preferred range is up to 28% by weight. If the densities of the matrix and fiber are dissimilar, then the matrix material may form from about 5 to about 40% by volume, preferably about 6 to 30%, more preferably 7 to 24%, and most preferably about 8 to 22%, based on the volume of an individual layer or the final composite. In the embodiments which include a second matrix material, then the very low modulus elastomeric matrix material may generally form from about 5 to about 35% by weight, preferably about 10 to 25%, more preferably 11 to 20%, and most preferably about 18 to 22% and the second matrix material may correspondingly generally form from about 5 to about 30% by weight, preferably about 6 to 14%, more preferably 7 to 14%, and most preferably about 8 to 12% based on the weight of the layer or the final composite.

The fiber network layers of the present invention typically contain from about 6 to 12 fiber ends per inch (2.4 to 4.7 ends per cm) and preferably 8 to 11 ends per inch (3.2 to 4.3 ends per cm). Each layer (including matrix material and film) is typically from 2 (50) to 5 (127), preferably 2.5 (64) to 4.5 (114), and most preferably 3 (76) to 4 (102) mil (μm) thick.

The areal density (AD) is used to indicate the amount of fiber and/or matrix material per unit area of an individual layer. It is determined by the number of yarn strands laid per unit width of sheet and the amount of matrix material applied to the yarn. Typically, if a 1300 denier/240 filament yarn is laid 10 ends per inch, the fiber areal density in the sheet would be about 45 to 60 $g/m^2$, preferably about 50 to 55 $g/m^2$.

The following examples are presented to demonstrate the advantages of the invention. The specific techniques, conditions, materials, proportions and reported data set forth to illustrate the principles of the invention are exemplary and should not be construed as limiting the scope of the invention.

EXAMPLE 1

A composite article according to the present invention was prepared with 25 unidirectional extended chain polyethylene fiber (Spectra® 1000 available from Allied-Signal) network layers coated with Hycar 2671 acrylic latex resin. Each fiber network layer was rotated so that the fibers in each layer were at a 90° angle relative to the fibers in the adjacent layers. The composite article also included 25 layers of high density polyethylene film (Astrofilm E available from Raven Industries). The relative amounts of the respective components were 70 weight % fiber, 20 weight % resin, and 10 weight % film.

EXAMPLE 2

Example 2 was the same as in Example 1 except that Hycar 26083 resin was substituted for Hycar 2671 resin.

EXAMPLE 3

Example 3 was the same as in Example 1 except that a polypropylene film available from Himont was substituted for the polyethylene film.

EXAMPLE 4

Example 4 was the same as in Example 1 except that a film of Kraton D/polyethylene blend was substituted for the polyethylene film.

EXAMPLE 5

Example 5 was the same as in Example 1 except that a film of Kraton G/polyethylene blend was substituted for the polyethylene film.

From the foregoing description, one skilled in the art can easily ascertain the essential characteristics of this invention, and without departing from the spirit and scope thereof, can make various changes and modifications to the invention to adapt it to various usages and conditions.

What is claimed is:

1. An article comprising at least one network of high strength fibers having a tenacity of at least about 7 g/d, a tensile modulus of at least about 150 g/d and an energy-to-break of at least about 8 J/g, and an acrylic ester copolymer matrix material which coats the fibers and has a tensile modulus of less than 100 psi, a tenacity of less than 450 psi, a glass transition temperature of about −10° to about −20° C., and an elongation-to-break of at least about 2000%.

2. An article according to claim 1, wherein the high strength fibers have a tenacity of at least about 22 g/d, a tensile modulus of at least about 900 g/d, and an energy-to-break of at least about 27 J/g.

3. An article according to claim 1, wherein the acrylic ester copolymer matrix material has a tensile modulus of less than about 50 psi and a tenacity of less than about 400 psi.

4. An article according to claim 1, wherein the fibers are selected from at least one of the group consisting of extended chain polyethylene fiber, extended chain polypropylene fiber, aramid fiber, polyvinyl alcohol fiber, polyacrylonitrile fiber, carbon fiber and liquid crystalline fiber.

5. An article according to claim 4, wherein the fibers comprise extended chain polyethylene fibers.

6. An article according to claim 1, further comprising a second matrix material adjacent to the acrylic ester copolymer matrix material-coated fiber network.

7. An article according to claim 7, wherein the second matrix material is applied in the form of a film.

8. An article according to claim 7, wherein the film of second matrix material is selected from the group consisting of high density polyethylene, polypropylene, and a blend of polyethylene and a block conjugated diene/vinyl aromatic copolymer.

9. An article according to claim 8, wherein the film of second matrix material comprises a high density polyethylene film.

10. An article according to claim 1, wherein the fibers are unidirectionally aligned.

11. A ballistic resistant multi-layer composite, comprising a plurality of layers of a network of high strength fibers having a tenacity of at least about 7 g/d, a tensile modulus of at least about 150 g/d and an energy-to-break of at least about 8 J/g, wherein an acrylic ester copolymer matrix material coats the fibers and has a tensile modulus of less than 100 psi, a tenacity of less than 450 psi, a glass transistion temperature of about −10° to about −20° C., and an elongation-to-break of at least about 2000%.

12. A composite according to claim 11, wherein the fibers comprises extended chain polyethylene fibers.

13. A composite according to claim 11, wherein the acrylic ester copolymer has a tensile modulus of less than about 50 psi and a tenacity of less than about 400 psi.

14. A composite according to claim 11, further comprising at least one second matrix material adjacent to at least one of the acrylic ester copolymer matrix material-coated fiber network layers.

15. A composite according to claim 14, wherein the second matrix material is applied in the form of a film.

16. A composite according to claim 15, wherein the film of second matrix material is selected from the group consisting of high density polyethylene, polyopropylene, and a blend of polyethylene and a block conjugated diene/vinyl aromatic copolymer.

17. A composite according to claim 12, wherein the film of second matrix material comprises a high density polyethylene film.

18. A composite according to claim 12, wherein the fibers of each fiber network layer are unidirectionally aligned and the fiber alignment of at least one fiber network layer is rotated relative to the fiber alignment of another fiber network layer.

19. A composite according to claim 18, wherein the fibers of each fiber network layer are rotated at an angle of about 90° relative to the fibers of an adjacent fiber network layer.

20. An article according to claim 6, wherein the second matrix material is present in an amount of about 5 to about 30% by weight, based on the weight of the fiber network layer.

* * * * *